US010388477B2

(12) United States Patent
Sullivan et al.

(10) Patent No.: US 10,388,477 B2
(45) Date of Patent: Aug. 20, 2019

(54) CONTACTOR DEVICE INTEGRATING PYROTECHNIC DISCONNECT FEATURES

(71) Applicant: GIGAVAC, LLC, Carpenteria, CA (US)

(72) Inventors: Daniel Sullivan, Santa Barbara, CA (US); Murray Stephan McTigue, Carpenteria, CA (US); Michael Henry Molyneux, Santa Barbara, CA (US)

(73) Assignee: GIGAVAC, LLC, Carpenteria, CA (US)

( * ) Notice: Subject to any disclaimer, the term of this patent is extended or adjusted under 35 U.S.C. 154(b) by 0 days.

(21) Appl. No.: 16/101,143

(22) Filed: Aug. 10, 2018

(65) Prior Publication Data

US 2018/0350540 A1 Dec. 6, 2018

Related U.S. Application Data

(63) Continuation-in-part of application No. 15/889,516, filed on Feb. 6, 2016, which is a continuation of (Continued)

(51) Int. Cl.
*H01H 39/00* (2006.01)
*H01H 50/54* (2006.01)

(Continued)

(52) U.S. Cl.
CPC ..... *H01H 39/00* (2013.01); *H01H 50/18* (2013.01); *H01H 50/54* (2013.01); *H01H 71/02* (2013.01);

(Continued)

(58) Field of Classification Search
CPC ..... H01H 39/00; H01H 50/18; H01H 50/54; H01H 71/02; H01H 71/10; H01H 89/00; H01H 33/18; H01H 2223/002
See application file for complete search history.

(56) References Cited

U.S. PATENT DOCUMENTS 2,729,722 A 1/1956 Nelson
2,999,912 A * 9/1961 Kincaid ..... H01H 39/00 200/16 B (Continued)

FOREIGN PATENT DOCUMENTS

DE 241431 3/1911
DE 202012013004 8/2014

(Continued)

OTHER PUBLICATIONS

FR 2741994 A1 Machine Translation.*

(Continued)

*Primary Examiner* — Mohamad A Musleh
(74) *Attorney, Agent, or Firm* — Ferguson Case Orr Paterson LLP

(57) ABSTRACT

Disclosed herein are contactor devices, for example, devices that can be utilized as switching elements, comprising fixed contacts that are electrically isolated from one another and one or more moveable contacts that are configured to electrically contact the fixed contacts to provide an electrical connection between them. Movement of the fixed contacts into and out of electrical contact with the fixed contacts controls flow of electricity through the devices. The contactor devices also include pyrotechnic disconnect elements, which function as a circuit break or fuse-like element to protect against overcurrent. When the electrical current through the contactor device reaches a threshold level, a pyrotechnic charge activates, permanently forcing the moveable contacts out of electrical contact with the fixed contacts.

25 Claims, 4 Drawing Sheets

Related U.S. Application Data application No. 15/146,300, filed on May 4, 2016, now Pat. No. 9,887,055.

(60) Provisional application No. 62/163,257, filed on May 18, 2015, provisional application No. 62/612,988, filed on Jan. 2, 2018.

(51) Int. Cl.

| | |
|---|---|
| ***H01H 50/18*** | (2006.01) |
| ***H01H 71/10*** | (2006.01) |
| ***H01H 89/00*** | (2006.01) |
| ***H01H 71/02*** | (2006.01) |
| ***H01H 85/143*** | (2006.01) |
| ***H01H 85/165*** | (2006.01) |
| *H01H 33/18* | (2006.01) |

(52) U.S. Cl.

CPC ..... *H01H 71/10* (2013.01); *H01H 85/143* (2013.01); *H01H 85/165* (2013.01); *H01H 89/00* (2013.01); *H01H 33/18* (2013.01); *H01H 2223/002* (2013.01)

(56) References Cited

U.S. PATENT DOCUMENTS

| | | | | |
|---|---|---|---|---|
| 3,724,870 | A * | 4/1973 | Kurokawa | B60R 21/2644 102/531 |
| 3,796,980 | A | 3/1974 | Ellsworth | |
| 4,354,072 | A * | 10/1982 | Noeske | H01H 39/00 200/82 A |
| 5,583,729 | A | 12/1996 | Hassler | |
| 6,136,114 | A * | 10/2000 | Johnson | C06B 23/007 149/22 |
| 8,446,241 | B2 * | 5/2013 | Filiputti | H01H 39/00 335/185 |
| 9,887,055 | B2 | 2/2018 | McTigue et al. | |
| 2009/0127229 | A1 * | 5/2009 | Schmitz | H01H 9/36 218/22 |
| 2010/0089739 | A1 * | 4/2010 | Filiputti | H01H 39/00 200/82 R |
| 2010/0097166 | A1 * | 4/2010 | Hasel | H01F 7/1607 335/279 |
| 2017/0229267 | A1 * | 8/2017 | Lell | H01H 39/00 |
| 2017/0229268 | A1 | 8/2017 | Goldman et al. | |
| 2017/0236663 | A1 * | 8/2017 | Jung | H01H 33/666 218/140 |
| 2018/0166246 | A1 | 6/2018 | McTigue et al. | |

FOREIGN PATENT DOCUMENTS

| | | | | |
|---|---|---|---|---|
| EP | 0548390 | A1 * | 6/1993 | H01H 39/00 |
| FR | 2741994 | A1 * | 6/1997 | H01H 39/00 |
| GB | 143554 | | 5/1976 | |
| JP | WO 2009041064 | A1 * | 4/2009 | H01H 39/00 |
| WO | WO 2008-095452 | A1 | 8/2008 | |

OTHER PUBLICATIONS

FR 2741994 A1 English Machine Translation.*

PCT International Search Report for Application No. PCT/US2016/032199; dated Jul. 22, 2016.

* cited by examiner

CONTACTOR DEVICE INTEGRATING PYROTECHNIC DISCONNECT FEATURES

CROSS REFERENCE TO RELATED APPLICATIONS

This application is a continuation-in-part of, and claims the benefit of, U.S. application Ser. No. 15/889,516 to Murray Stephan McTigue, et al., entitled Mechanical Fuse Device, filed on Feb. 6, 2018, which in turn is a continuation-in-part of, and claims the benefit of, U.S. application Ser. No. 15/146,300 to Murray Stephan McTique, et al., entitled Mechanical Fuse Device, filed on May 4, 2016, which in turn claims the benefit of U.S. Provisional Application Ser. No. 62/163,257 to Murray S. McTigue, et al., entitled Mechanical Fuse Device, filed on May 18, 2015. U.S. application Ser. No. 15/889,516, and the present application, both further claims the benefit of U.S. Provisional Application 62/612,988 to Daniel Sullivan, et al., entitled Contactor Device Integrating Pyrotechnic Disconnect, filed on Jan. 2, 2018. Each of these applications are hereby incorporated herein in their entirety by reference.

BACKGROUND

Field of the Invention

Described herein are devices relating to electrical contactors for use with electrical devices and systems. The devices described herein also relate to electrical disconnects configured to function as sacrificial fuse-like devices for overcurrent protection.

Description of the Related Art

Connecting and disconnecting electrical circuits is as old as electrical circuits themselves and is often utilized as a method of switching power to a connected electrical device between "on" and "off" states. An example of one device commonly utilized to connect and disconnect circuits is a contactor, which is electrically connected to one or more devices or power sources. A contactor is configured such that it can interrupt or complete a circuit to control electrical power to and from a device. One type of conventional contactor is a hermetically sealed contactor.

In addition to contactors, which serve the purpose of connecting and disconnecting electrical circuits during normal operation of a device, various additional devices can be employed in order to provide overcurrent protection. These devices can prevent short circuits, overloading, and permanent damage to an electrical system or a connected electrical device. These devices include disconnect devices which can quickly break the circuit in a permanent way such that the circuit will remain broken until the disconnect device is repaired, replaced, or reset. One such type of disconnect device is a fuse. A conventional fuse is a type of low resistance resistor that acts as a sacrificial device. Typical fuses comprise a metal wire or strip that melts when too much current flows through it, interrupting the circuit that it connects.

As society advances, various innovations to electrical systems and electronic devices are becoming increasingly common. An example of such innovations include recent advances in electrical automobiles, which may one day become the energy-efficient standard and replace traditional petroleum-powered vehicles. In such expensive and routinely used electrical devices, overcurrent protection is particularly applicable to prevent device malfunction and prevent permanent damage to the devices. Furthermore, overcurrent protection can prevent safety hazards, such as electrical fires.

One issue in utilizing conventional contactors and disconnect devices is that if a circuit design requires both a contactor and a disconnect device, for example, to provide both a switch for ordinary operation and an overcurrent protection element, at least two separate devices must be utilized. Especially in expensive modern electrical devices, such as electric cars, this requires precious additional space to accommodate the plurality of devices, as well as necessitating additional design considerations to connect a plurality of devices in circuit to the electrical device.

SUMMARY

Described herein are contactors, configured to interrupt or complete a connected circuit, which also comprise at least one disconnect element configured to provide overcurrent protection by permanently breaking a connected circuit, such that the circuit will remain broken until the disconnect device is repaired, replaced, or reset. In some embodiments, the disconnect element comprises pyrotechnic features. When these pyrotechnic features are activated, the resulting explosion generates sufficient force to cause movement or change in orientation between internal features in the contactor, resulting in a permanent circuit break.

In one embodiment, a contactor device, comprises a housing and internal components within the housing configured to change the state of said contactor device to and from a closed state and an open state in response to input. The closed state allows current flow through the device and the open state interrupts current flow through the device. The device further comprises contact structures electrically connected to the internal components for connection to external circuitry and pyrotechnic elements. The contactor device is configured such that when a threshold current level passes through said internal components, said pyrotechnic features activate, which causes said internal components to transition said contactor device to said open state.

In another embodiment, a contactor device, comprises a housing and internal components comprising fixed contacts electrically isolated from one another and at least partially surrounded by the housing, one or more moveable contacts allowing current flow between the fixed contacts when the moveable contacts are contacting the fixed contacts, a shaft structure connected to the moveable contacts, and contact structures electrically connected to the internal components for connection to external circuitry. The contactor device further comprises pyrotechnic features configured such that when a threshold current level passes through the internal components, the pyrotechnic features activate and interact with the shaft structure, such that the shaft structure changes configuration, such that the moveable contacts separate from the fixed contacts.

In still another embodiment a contactor device comprises a housing and internal components comprising fixed contacts electrically isolated from one another, and at least partially surrounded by the housing, one or more moveable contacts allowing current flow between the fixed contacts when the moveable contacts are contacting the fixed contacts, a shaft structure connected to the moveable contacts, a plunger structure connected to the shaft structure, contact structures electrically connected to the internal components for connection to external circuitry, and a solenoid configured to control movement of the plunger structure. The contactor device further comprises pyrotechnic features configured such that when a threshold current level passes through the internal components, the pyrotechnic features activate and interact with the shaft structure, such that the shaft structure changes configuration, such that the moveable contacts separate from said fixed contacts.

These and other further features and advantages of the invention would be apparent to those skilled in the art from the following detailed description, taken together with the accompanying drawings, wherein like numerals designate corresponding parts in the figures, in which:

DETAILED DESCRIPTION

Figure 1:
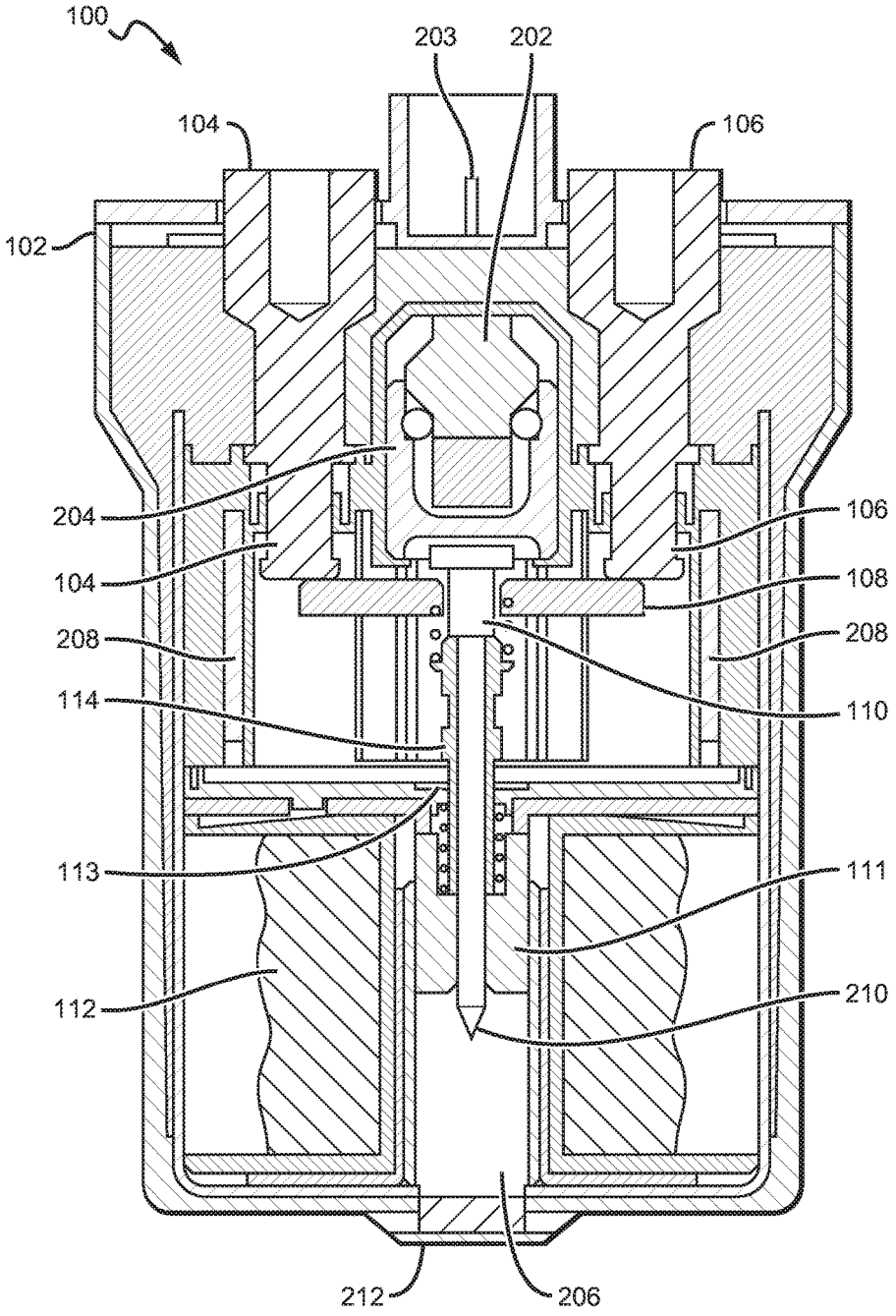
FIG. 1 is a front sectional view of an embodiment of a contactor incorporating features of the present invention, shown in the "closed" orientation that allows flow of electricity through the device.

The present disclosure will now set forth detailed descriptions of various embodiments. These embodiments set forth contactor devices comprising a housing containing internal components configured to change the state of the device between a state that allows for electricity to flow through the device and a state that does not allow electricity to flow through the device and vice versa.

The change between these two states can be in response to various forms of input that can be received, for example, manual input such as a user pressing a button to perform a "switching" function utilizing the contactor device. Other forms of input can include automated input, for example, sensors or a set of computer commands stored in non-transient medium executed by a processor that will cause the internal components to transition between states in response to timing information or system information detected by sensors in communication with the disconnect device, for example, current, voltage or temperature sensors. In response to this input, the internal components can activate as described herein, for example, by activating a solenoid or manual mechanism, and change configuration to change between the two states.

In some embodiments, the internal components of contactor devices incorporating features of the present invention comprise fixed contacts that are electrically isolated from one another and one or more moveable contacts that are configured to electrically contact the fixed contacts to allow flow of electricity between them. In some embodiments, the moveable contact is connected to a shaft structure and movement of the shaft and therefore the moveable contact is controlled through user input, such that the moveable contact can be selectively separated from the fixed contacts to prevent flow of electricity through the device. Likewise, the moveable contact can be selectively placed into contact with the fixed contacts to allow flow of electricity through the device.

In addition to the above ordinary operation, devices incorporating features of the present invention can include pyrotechnic disconnect features that function as overcurrent protection, for example, in manner similar to a fuse or circuit breaker, resulting in the device becoming permanently inoperable, for example, functioning as a sacrificial feature. When a sufficient level of current passes through the device, representing a dangerous level of current that could permanently damage an expensive connected electrical device or representing a hazard such as causing an electrical fire, a pyrotechnic charge within the device triggers. The resulting pyrotechnic explosion generates sufficient force to cause the internal components to interact with each other, resulting in the moveable contact becoming permanently separated from the fixed contacts.

In some embodiments, devices incorporating features of the present invention can incorporate a piston structure that can be positioned near or around the pyrotechnic charge. When the pyrotechnic charge is activated, the resulting force pushes the piston structure away from the pyrotechnic charge and drives the piston structure onto the moveable contact assembly, pushing the moveable contact away from the fixed contacts.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

It is also understood that when an element or feature is referred to as being "on" or "adjacent" to another element or feature, it can be directly on or adjacent to the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present.

Relative terms, such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between," two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

FIG. 1 shows a sectional view of an example embodiment of a contactor device 100, which comprises an integrated pyrotechnic disconnect component which can function as a sacrificial disconnect in the event of overcurrent. FIG. 1 shows the contactor device 100 in a "closed" circuit position, wherein flow of electricity through the contactor device is enabled. FIG. 1 further shows the pyrotechnic disconnect portion of the contactor device 100 in its non-triggered or "set" mechanical orientation, allowing the contactor device to function normally to operate between its "closed" and "open" position. The disconnect portion of the contactor device 100 also has a "triggered" orientation, where the circuit is broken and the flow of electricity through the contactor device is permanently disabled until the device is replaced or repaired and reset. Both the "closed" and "open" contactor modes and the "set" and "triggered" disconnect modes are described in more detail further herein.

The contactor device 100 of FIG. 1 comprises a body 102 (also referred to as a housing 102), and two or more fixed contact structures 104, 106 (two shown) which are configured to electrically connect the internal components of the contactor device to external circuitry, for example, to an electrical system or device. The body 102 can comprise any suitable material that can support the structure and function of the contactor device 100 as disclosed herein, with a preferred material being a sturdy material that can provide structural support to the contactor device 100 without interfering with the electrical flow through the fixed contacts 104, 106 and the internal components of the device. In some embodiments, the body 102 comprises a durable plastic or polymer. The body 102 at least partially surrounds the various internal components of the contactor device 100, which are described in more detail further herein.

The body 102 can comprise any shape suitable for housing the various internal components including any regular or irregular polygon. The body 102 can be a continuous structure, or can comprise multiple component parts joined together, for example, comprising a base body "cup," and a top "header" portion sealed with an epoxy material. Some example body configurations include those set forth in U.S. Pat. Nos. 7,321,281, 7,944,333, 8,446,240 and U.S. Pat. No. 9,013,254, all of which are assigned to Gigavac, Inc., the assignee of the present application, and all of which are hereby incorporated in their entirety by reference.

The fixed contacts 104, 106 are configured such that the various internal components of the contactor device 100 that are housed within the body 102 can electrically communicate with an external electrical system or device, such that the contactor device 100 can function as a switch to break or complete an electrical circuit as described herein. The fixed contacts 104, 106 can comprise any suitable conductive material for providing electrical contact to the internal components of the contactor device, for example, various metals and metallic materials or any electrical contact material or structure that is known in the art. The fixed contacts 104, 106 can comprise single continuous contact structures (as shown) or can comprise multiple electrically connected structures. For example, in some embodiments, the fixed contacts 104, 106 can comprise two portions, a first portion extending from the body 102, which is electrically connected to a second portion internal to the body 102 that is configured to interact with other components internal to the body as described herein.

The body 102 can be configured such that the internal space of the body 102, which houses the various internal components of the contactor device 100, is hermetically sealed. When coupled with the use of electronegative gas, this hermetically sealed configuration can help mitigate or prevent electrical arcing between adjacent conductive elements, and in some embodiments, helps provide electrical isolation between spatially separated contacts. In some embodiments, the body 102 can be under vacuum conditions. The body 102 can be hermetically sealed utilizing any known means of generating hermetically sealed electrical devices. Some examples of hermetically sealed devices include those set forth in U.S. Pat. Nos. 7,321,281, 7,944,333, 8,446,240 and 9,013,254, all of which are assigned to Gigavac, Inc., the assignee of the present application, and all of which are incorporated into the present application in their entirety by reference.

In some embodiments, the body 102 can be at least partially filled with an electronegative gas, for example, sulfur hexafluoride or mixture of nitrogen and sulfur hexafluoride. In some embodiments, the body 102 comprises a material having low or substantially no permeability to a gas injected into the housing. In some embodiments, the body can comprise various gasses, liquids or solids configured to increase performance of the device.

Before describing the pyrotechnic disconnect components of the contactor device 100 used for overcurrent protection, the contactor components utilized during ordinary switching use of the contactor device 100 will be described first. When not interacting with any of the other components internal to the body 102, the fixed contacts 104, 106 are otherwise electrically isolated from one another such that electricity cannot freely flow between them. The fixed contacts 104, 106 can be electrically isolated from one another through any known structure or method of electrical isolation.

When the contactor device 100 is in its "closed" position, as shown in FIG. 1, both of the otherwise electrically isolated fixed contacts 104, 106 are contacted by a moveable contact 108, such that the moveable contact 108 functions as a bridge allowing an electrical signal to flow through the device, for example, from the first fixed contact 104, to the moveable contact 108, to the second contact structure 106 or vice versa. Therefore, the contactor device 100 can be connected to an electrical circuit, system or device and complete a circuit while the moveable contact is in electrical contact with the fixed contacts.

The moveable contact 108 can comprise any suitable conductive material including any of the materials discussed herein in regard to the fixed contacts 104, 106. Like with the fixed contacts 104, 106, the moveable contact 108 can comprise a single continuous structure (as shown), or can comprise multiple component parts electrically connected to one another so as to serve as a contact bridge between the otherwise electrically isolated fixed contacts 104, 106, so that electricity can flow through the contactor device 100.

The moveable contact 108 can be configured such that it can move into and out of electrical contact with the fixed contacts 104, 106, causing the circuit to be "closed" or completed when the moveable contact is in electrical contact with the fixed contacts 104, 106, and to be "open" or broken when the moveable contact 108 is not in electrical contact with the fixed contacts 104, 106, as the fixed contacts 104, 106 are otherwise electrically isolated from one another when not contacting the moveable contact 108. In some embodiments, including the embodiment shown in FIG. 1, the moveable contact 108 is physically connected to a shaft structure 110, which is configured to move along a predetermined distance within the contactor device 100. The shaft 110 can comprise any material or shape suitable for its function as an internal moveable component that is physically connected to the moveable contact 108, such that the moveable contact 108 can move with the shaft 110.

Movement of the shaft 110 controls movement of the moveable contact 108, which in turn controls the position of the moveable contact 108 in relation to the fixed contacts 104, 106, which in turn controls flow of electricity through the contactor device 100 as described herein. Movement of the shaft can be controlled through various configurations, including, but not limited to, electrical and electronic, magnetic and solenoid, and manual. Example manual configurations for controlling a shaft connected to a moveable contact are set forth in U.S. Pat. No. 9,013,254, to Gigavac, Inc., the assignee of the present application, and all of which is incorporated into the present application in its entirety by reference. Some of these example configurations of manual control features include magnetic configurations, diaphragm configurations and bellowed configurations.

In the embodiment shown in FIG. 1, movement of the shaft 110 is controlled through the use of a solenoid configuration. A plunger structure 111 is connected to, or at least partially surrounds, a portion of the shaft 110. The body 102 also houses a solenoid 112. Many different solenoids can be used, with one example of a suitable solenoid being a solenoid operating under a low voltage and with a relatively high force. One example of a suitable solenoid is commercially available solenoid Model No. SD1564 N1200, from Bicron Inc., although many other solenoids can be used. In the embodiment shown, the plunger structure 111 can comprise a metallic material that can be moved and controlled by the solenoid 112. Movement of the plunger structure 111 controls movement of the connected shaft 110, which in turn controls movement of the connected moveable contact 108.

The travel distance of the shaft 110 can be controlled utilizing various features, for example, springs to control travel/overtravel distance or various portions of the body 102 that can block or restrict the travel distance of the shaft 110. In the embodiment shown in FIG. 1, the travel distance of the shaft 110 is partially controlled by a hard stop 113, which is configured to abut against a winged portion 114 of the shaft 110, to limit the distance of the shaft 110 when the shaft 110 has traveled a sufficient distance from the fixed contacts 104, 106. The hard stop 113 can comprise any material or shape suitable for providing a surface to interact with the shaft 110 in order to limit the movement or travel distance of the shaft 110. In the embodiment shown in FIG. 1, the hard stop 113 comprises a plastic material. In some embodiments, the hard stop 113 is configured to break or shear off when the pyrotechnic disconnect elements are triggered, as will be discussed in more detail further below.

Now that the basic switching features of the contactor device 110 have been set forth, the pyrotechnic disconnect elements will now be described. The contactor device 100 can comprise several elements that can function as overcurrent protection, including a pyrotechnic charge 202 and a piston structure 204. The piston structure 204 can be positioned near or at least partially around one or more of the internal components, for example, the shaft 110 as shown, such that movement of the piston from a resting position can change the configuration of the internal components to interrupt flow of electricity through the device, for example, by pushing against or otherwise moving the shaft 100 as described herein. The pyrotechnic charge 202 can be configured such that it is activated when current exceeds a predetermined threshold level, in order to prevent permanent damage to a connected electric device or a safety hazard such as an electrical fire.

The contactor device 100 can comprise various sensor features that can detect when current through the device has reached a dangerous level and can trigger the pyrotechnic charge when this threshold level has been detected. In some embodiments, the contactor device 100 can comprise a dedicated current sensor configured to detect the level of current flowing through the device. The current sensor can be configured to directly or indirectly activate the pyrotechnic charge when the current has reached a threshold level. In some embodiments, the current sensors can transmit a signal proportional to the detected current to activate the pyrotechnic charge when a threshold current level is detected. In some embodiments, the current sensors can comprise a Hall effect sensor, a transformer or current clamp meter, a resistor, a fiber optic current sensor, or an interferometer.

In some embodiments, the pyrotechnic charge is configured to be activated by electrical pulse and is driven by an airbag system configured to detect multiple factors, similar to that utilized in modern vehicles. In some embodiments, the contactor device 100 can comprise one or more pyrotechnic pins 203 that can be configured to trigger the pyrotechnic charge 202 when the pins 203 receive an activation signal. In some embodiments, the pyrotechnic charge can be connected to another feature that already monitors the flowing current. This other feature, for example, a battery management component, can then be configured to send a signal to activate the pyrotechnic charge when a threshold current level is detected.

The pyrotechnic charge 202 can be a single charge structure or a multiple charge structure. In some embodiments, the pyrotechnic charge 202 comprises a double charge structure comprising first an initiator charge and then a secondary gas generator charge. Many different types of pyrotechnic charges can be utilized provided the pyrotechnic charge used is sufficient to provide sufficient force to move the piston structure 204 to permanently break the circuit of the contactor device 100 as described herein. In some embodiments, the pyrotechnic charge 202 comprises zirconium potassium perchlorate, which has the advantage of being suitable for use as both an initiator charge and a gas generator charge. In some embodiments, the initiator charge comprises a fast-burning material such as zirconium potassium perchlorate, zirconium tungsten potassium perchlorate, titanium potassium perchlorate, zirconium hydride potassium perchlorate, or titanium hydride potassium perchlorate. In some embodiments, the gas generator charge comprises a slow-burning material such as boron potassium nitrate, or black powder.

When the pyrotechnic charge 202 is activated, the resulting force causes the piston structure 204 to be driven away from its resting position near or around the pyrotechnic charge 202, which in turn causes the piston structure 204 to push against the shaft 110 and cause the shaft to be driven away from the fixed contacts 104, 106. The resulting force is also sufficient to break or shear off the hard stop 113, causing the shaft 110 to be forced even further away from the fixed contacts 104, 106, for example, being pushed into a separate internal compartment 206 of the body 102. The piston structure 204 can comprise sufficient dimensions (e.g. shape, size, spatial orientation or other configuration) such that the piston structure 204 can hold the internal components in a position or configuration wherein electricity cannot flow through the contactor device, for example, by holding the shaft 110 in place further away from the fixed contacts 104, 106, such as, by holding the shaft 110 such that it is substantially within the separate internal compartment 206 of the body 102. This in turn causes the moveable contact 108, which is connected to the shaft 110, to be separated by an even larger spatial gap from the fixed contacts 104, 106, causing the device to be in the "triggered" or permanent "open" configuration wherein electricity cannot flow through the device. In some embodiments, the piston structure 204 comprises sufficient dimensions such that once it is displaced by activation of the pyrotechnic features 202, the piston structure 204 is forced into a position where it interacts with a portion of the body 102, such that it cannot easily be moved.

In addition to the rapidly created large spatial gap between the fixed contacts 104, 106 and the moveable contact 108, additional structures can be utilized. For example, in some embodiments, one or more arc blowout magnets 208 (two shown) can be utilized to further control electrical arcing. While the main method for interrupting current flow is to rapidly open the contacts to a much larger air gap as described herein, there can also be additional performance gained through a secondary gas blast directed at the arc, for example, through use of a gas generator charge.

In some embodiments, including the embodiment shown in FIG. 1, other optional design features can be included which can help prevent hazards caused by the rapid buildup of gas resulting from the activation of the pyrotechnic charge 202. In these embodiments, the body 102 can be configured such that when the pyrotechnic charge 202 is activated, the piston structure 204 drives the shaft 110 with sufficient force to puncture a portion of the body 102. This will allow the rapid buildup of gas to escape. This is achieved, in some embodiments, by a portion of the body 102 comprising a membrane that can be punctured during the pyrotechnic disconnect cycle, for example, by a sharp portion 210 of the shaft 110, allowing gas to escape from a connected vent portion 212 of the body 102, which can be a high temperature filter membrane. The high temperature gas can then pass out of the body 102. The pressure release may cool the electrical arc and improve performance as well as prevent the contactor housing from rupturing.

Figure 2:
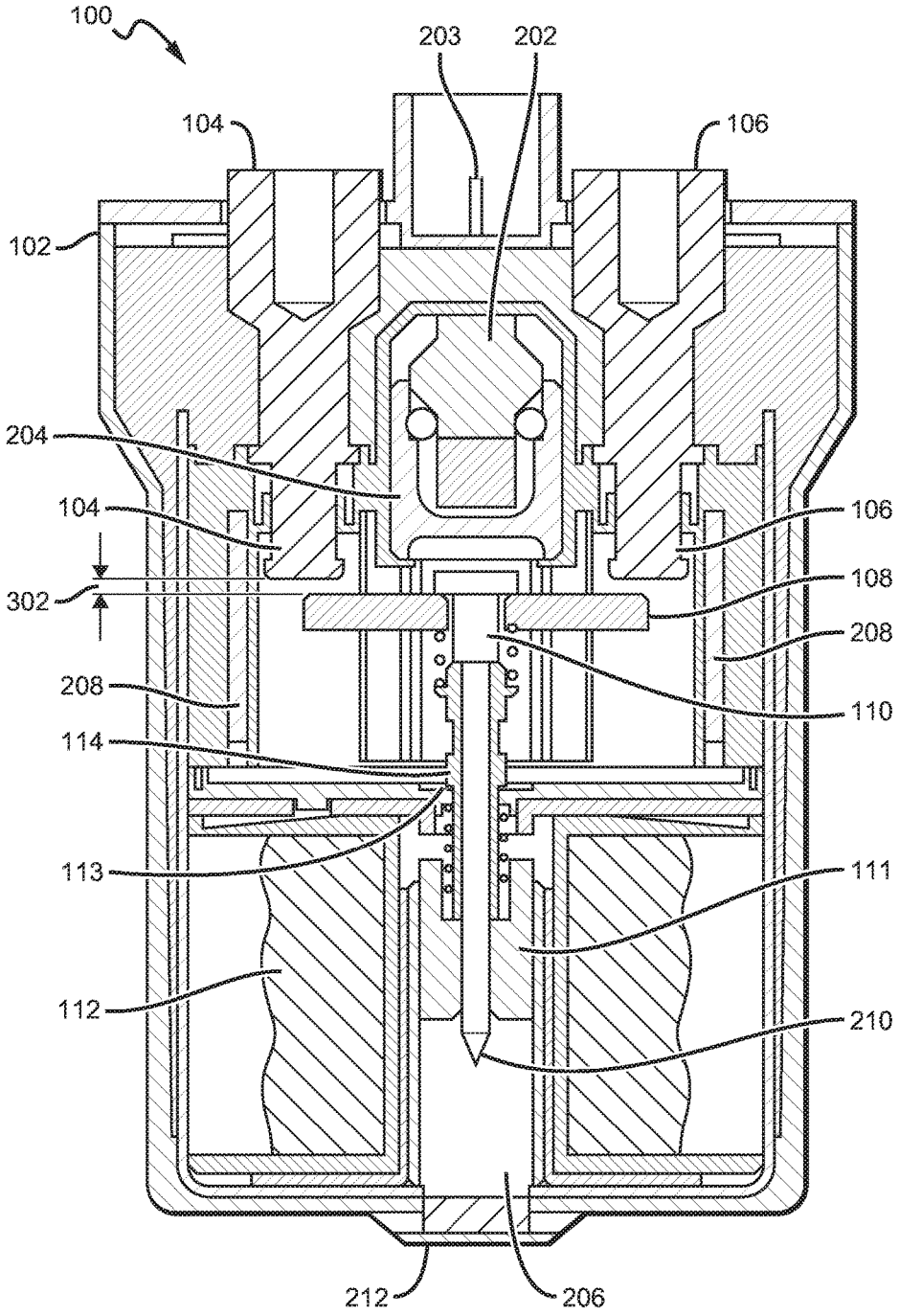
FIG. 2 is a front sectional view of the embodiment of the contactor device of FIG. 1, shown in an "open" or "disconnected" orientation that prevents flow of electricity through the device.
Figure 3:
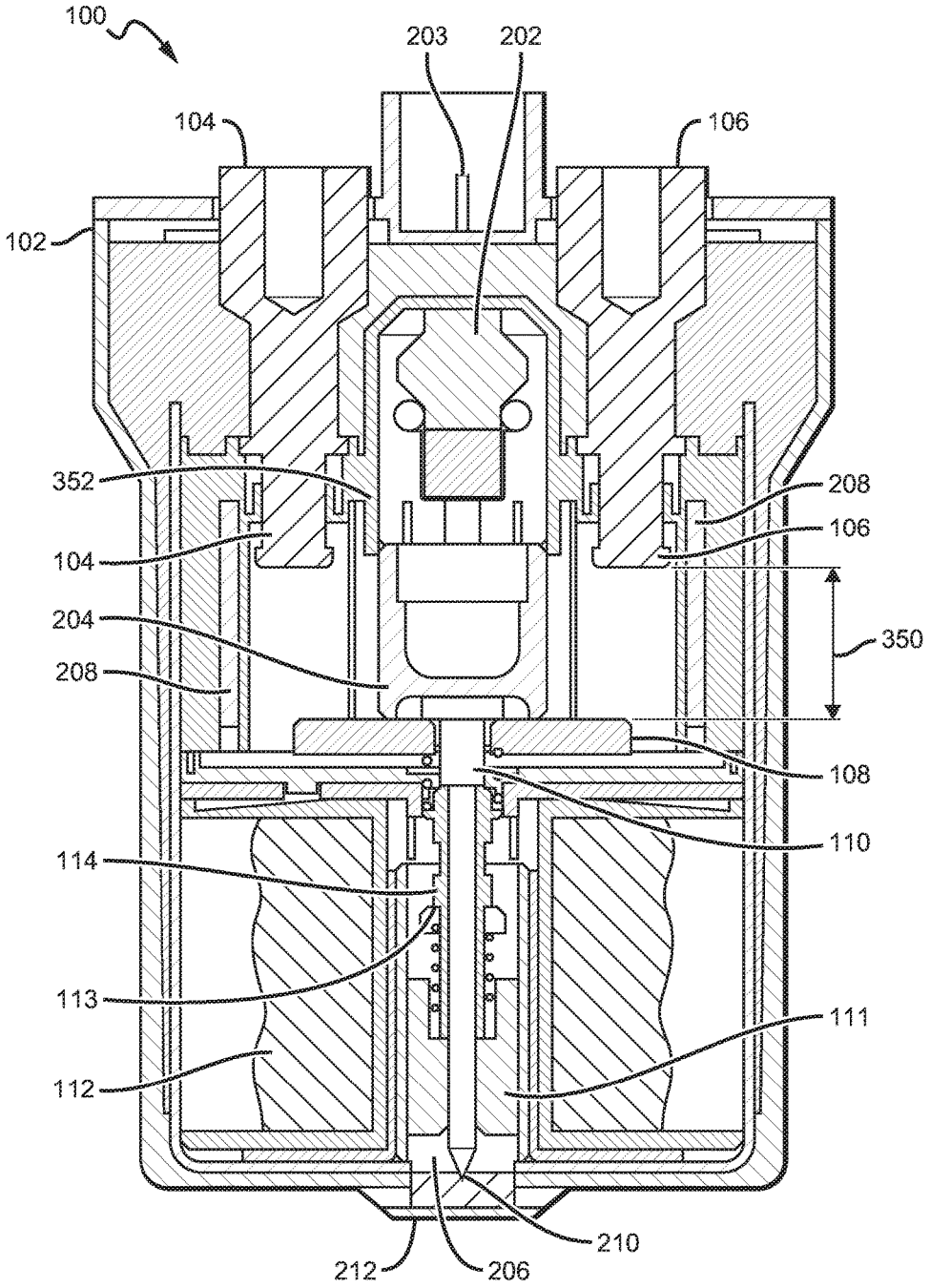
FIG. 3 is a front sectional view of the embodiment of the contactor device of FIG. 1, shown in a different orientation, wherein the disconnect elements have been "triggered.

The differences between breaking the circuit of electrical flow through the contactor device 100 during normal switching operation and the permanent breaking of the circuit of electrical flow through the contactor device 100 when the device is in its "triggered" state is better illustrated in FIGS. 2-3. FIGS. 2-3 shown the contactor device 100 of FIG. 1, but in different orientations. Like in FIG. 1, FIGS. 2-3 show the body 102, the fixed contacts 104, 106, the moveable contact 108, the shaft 110, the plunger structure 111, the solenoid 112, the hard stop 113, the winged portion 114 of the shaft 110, the pyrotechnic charge 202, the pyro pins 203, the piston structure 204, the separate compartment 206 of the body 102, the arc blowout magnets 208, the sharp portion 210 of the shaft 110, and the vent portion 212 of the body 102.

The contactor device 100 is shown in its "open" state in FIG. 2, which shows the shaft 110 moved such that the connected moveable contact 108 is separated from the fixed contacts 104, 106 by a disconnection spatial gap 302. The contactor device 100, as shown in FIG. 2, is still in the "set" position without the pyrotechnic features being activated. The disconnection spatial gap 302 causes the moveable contact 108 to be spaced a sufficient distance from the fixed contacts 104, 106, which are otherwise electrically isolated from one another, to interrupt flow of electricity through the device. In contrast, FIG. 3 shows the contactor device 100 in its triggered stated when the pyrotechnic charge 202 has been activated, causing the piston structure 204 to force the shaft 110 and moveable contact 108, in a direction further away from the fixed contacts 104, 106. This rapidly creates a larger circuit break spatial gap 350 between the fixed contacts 104, 106 and the moveable contact 108.

The resulting force from the activation of the pyrotechnic charge 202, and the resulting sudden movement of the piston structure 204 and the shaft 110, is sufficient to break or shear off the hard stop 113, which is shown in FIG. 3 to be displaced from its original position connected to the body 113. The hard stop 113 can comprise a sturdy material that is connected or integrated with the body 102, such that it functions as a stop for the shaft 110 during normal device operation between "closed" and "open" circuit states. However, during operation of the pyrotechnic disconnect features, the hard stop 113 can be intentionally designed to "fail" as a stop structure and break or shear off to allow the shaft 110 to proceed into the separate body compartment 206.

In some embodiments, the piston structure 204 can be configured such that it can interact with a piston-stop portion 352 of the body 102 after the pyrotechnic charge 202 has been activated, for example, by interacting with a position of the piston structure 204, for example, a portion of the piston-stop portion 352 configured to interact or mate with another portion on the piston structure 204. In some embodiments, the piston structure 204 will not be in a position to come into contact with the piston-stop portion 352 until after the piston structure 204 has been displaced by activation of the pyrotechnic charge 202. This causes the piston structure 204 to be held between the piston-stop portion 352 and the moveable contact 108, when the pyrotechnic charge 202 has been activated and the piston structure 204 has been forced from its resting position. As shown in FIG. 3, this configuration places the piston structure 204 in a position which holds or locks the piston structure 204 against the moveable contact 108. The piston structure 204 holds the moveable contact 108 in place and helps maintain the circuit break spatial gap 350 such that the fixed contacts 104, 106 and the moveable contact 108 cannot slip back into contact with each other, rendering the contactor device 100 nonoperational.

In some embodiments, in lieu of or in addition to the piston-stop portion 352 of the body 102, the separate compartment 206 of the body 102, can comprise sufficient dimensions including, for example, size and shape, such that the separate compartment 206 can interact with a portion of the shaft 110 that has moved into the separate compartment 206 due to activation of the pyrotechnic charge 202. In some embodiments, the separate compartment can be configured to interact with the sheared off hard stop 113 or another structure connected to the shaft 110 that has moved into the separate compartment 206 due to activation of the pyrotechnic charge 202. These portions of the shaft 110, or connected structures, were not previously within the separate compartment 206 during ordinary device operation, but are forced into the separate compartment 206 during the pyrotechnic cycle during overcurrent protection operation. The separate compartment 206 comprise a sufficient size, shape or additional features, for example, features configured to interact or mate with corresponding features on the shaft 110 or connected structure, to hold the shaft 110 in place so the moveable contact 108 connected to the shaft 110 cannot slip back into contact with the fixed contacts 104, 106.

Figure 4:
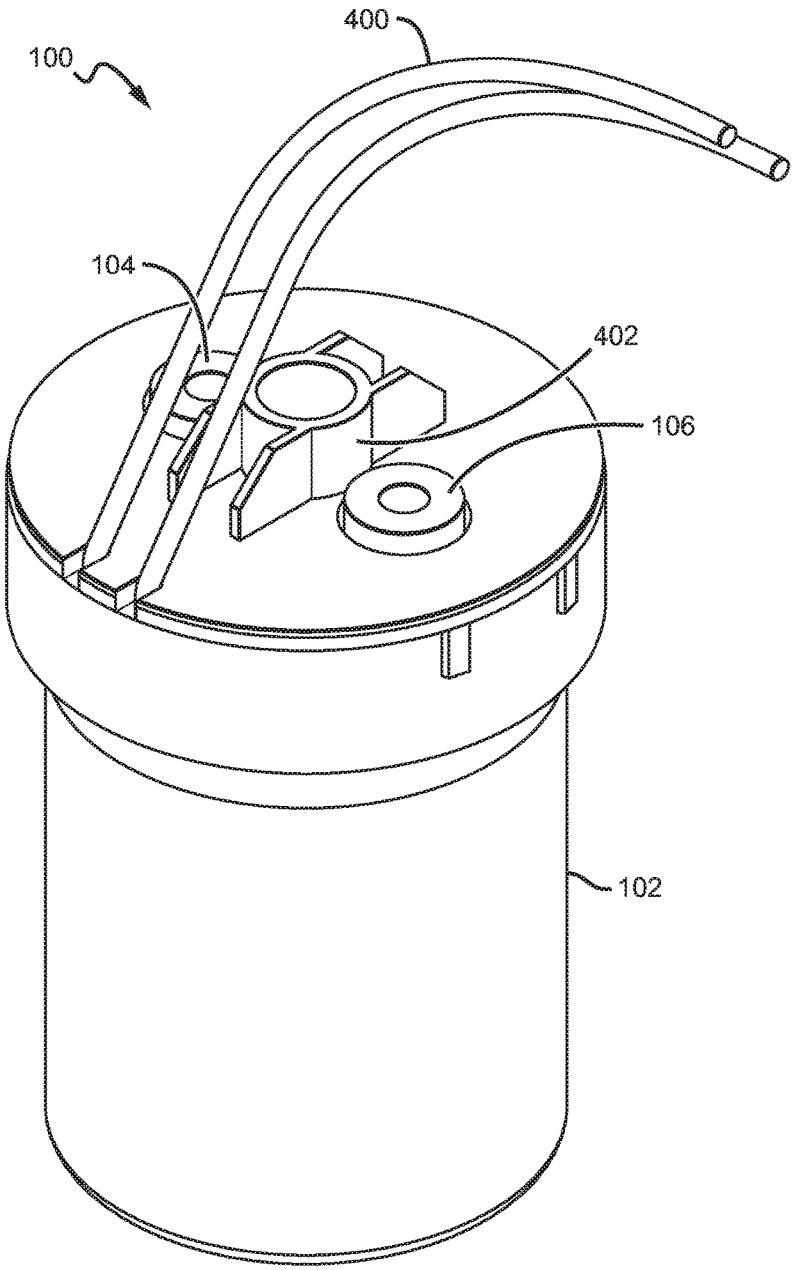
" and FIG. 4 is a top perspective view of the embodiment of the contactor device of FIG. 1.

The external features of the device are best shown in FIG. 4, which shows the contactor device 100 comprising the body 102 and the fixed contacts 104, 106 extending from the body 102 to allow for external connection of the internal components of the body to an external electrical device or system. FIG. 4 also shows lead wires 400, configured to provide electrical power to the internal solenoid (solenoid 112 in FIGS. 1-3) and optional pyrotechnic feature compartment 402, which can be configured to house sensory or activation features to interact with the internal pyrotechnic charge, for example, the pyrotechnic pins.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention, wherein no portion of the disclosure is intended, expressly or implicitly, to be dedicated to the public domain if not set forth in any claims.

We claim:

1. A contactor device, comprising:

a hermitically sealed housing;

internal components within said hermetically sealed housing, said internal components configured to change the state of said contactor device to and from a closed state and an open state in response to input, wherein said closed state allows current flow through said device and said open state interrupts current flow through said device;

contact structures electrically connected to said internal components for connection to external circuitry; and pyrotechnic elements also within said hermetically sealed housing, wherein said contactor device is configured such that when a threshold current level passes through said internal components, said pyrotechnic features activate, which causes said internal components to transition said contactor device to said open state.

2. The contactor device of claim 1, wherein said pyrotechnic elements comprise a pyrotechnic charge and said contactor device further comprises a piston structure near said pyrotechnic charge.

3. The contactor device of claim 2, wherein said piston structure is near said internal components and activation of said pyrotechnic charge causes said piston structure to move and change the configuration of said internal components.

4. The contactor device of claim 3, wherein said piston structure at least partially surrounds a portion of one of the internal components.

5. The contactor device of claim 3, wherein said piston structure comprises sufficient dimensions to hold said internal components in said open state, and to prevent said internal components from transitioning into said closed state, when said piston structure has moved after pyrotechnic elements have been activated.

6. The contactor device of claim 3, wherein said pyrotechnic charge is configured to activate in response to an electrical pulse.

7. The contactor device of claim 3, wherein said pyrotechnic charge comprises zirconium potassium perchlorate.

8. A contactor device, comprising:

a housing;

internal components, said internal components comprising:

fixed contacts electrically isolated from one another, said fixed contacts at least partially surrounded by said housing;

one or more moveable contacts, said one or more moveable contacts allowing current flow between said fixed contacts when said one or more moveable contacts are contacting said fixed contacts;

a shaft structure connected to said one or more moveable contacts; and contact structures electrically connected to said internal components for connection to external circuitry; and pyrotechnic features configured such that when a threshold current level passes through said internal components, said pyrotechnic features activate and push said movable contacts away from said fixed contacts such that said moveable contacts separate from said fixed contacts.

9. The contactor device of claim 8, wherein said housing comprises a separate internal compartment within said housing.

10. The contactor device of claim 9, wherein said pyrotechnic elements comprise a pyrotechnic charge and said contactor device further comprises a piston structure near said pyrotechnic charge.

11. The contactor device of claim 10, wherein said piston structure is near said shaft structure and activation of said pyrotechnic charge causes said piston structure to push said shaft structure substantially into said separate internal compartment.

12. The contactor device of claim 11, wherein said piston structure comprises sufficient dimensions to hold said shaft structure in place, such that said shaft structure is substantially within said separate internal compartment.

13. The contactor device of claim 12, wherein said housing further comprises a piston-stop portion configured to hold said piston structure in place such that said piston structure cannot substantially move when said piston structure has been forced from a resting position by activation of said pyrotechnic features.

14. The contactor device of claim 12, wherein said housing is hermetically sealed.

15. A contactor device, comprising:

a housing;

internal components, said internal components comprising:

fixed contacts electrically isolated from one another, said fixed contacts at least partially surrounded by said housing;

one or more moveable contacts, said one or more moveable contacts allowing current flow between said fixed contacts when said one or more moveable contacts are contacting said fixed contacts;

a shaft structure connected to said one or more moveable contacts; and contact structures electrically connected to said internal components for connection to external circuitry; and pyrotechnic features configured such that when a threshold current level passes through said internal components, said pyrotechnic features activate and interact with said shaft structure, such that said shaft structure changes configuration, such that said moveable contacts separate from said fixed contacts, wherein said housing is hermetically sealed, wherein said housing comprises a separate internal compartment within said housing, wherein said pyrotechnic elements comprise a pyrotechnic charge and said contactor device further comprises a piston structure near said pyrotechnic charge, wherein said piston structure is near said shaft structure and activation of said pyrotechnic charge causes said piston structure to push said shaft structure substantially into said separate internal compartment, wherein said piston structure comprises sufficient dimensions to hold said shaft structure in place, such that said shaft structure is substantially within said separate internal compartment and wherein said shaft comprises a sharp portion configured to puncture a portion of said housing and release internal device pressure in response to activation of said pyrotechnic features.

16. The contactor device of claim 15, further comprising a vent portion comprising a high temperature filter membrane.

17. A contactor device, comprising:

a housing;

internal components, said internal components comprising:

fixed contacts electrically isolated from one another, said fixed contacts at least partially surrounded by said housing;

one or more moveable contacts, said one or more moveable contacts allowing current flow between said fixed contacts when said one or more moveable contacts are contacting said fixed contacts;

a shaft structure connected to said one or more moveable contacts; and contact structures electrically connected to said internal components for connection to external circuitry; and pyrotechnic features configured such that when a threshold current level passes through said internal components, said pyrotechnic features activate and interact with said shaft structure, such that said shaft structure changes configuration, such that said moveable contacts separate from said fixed contacts, wherein said housing comprises a separate internal compartment within said housing, wherein said pyrotechnic elements comprise a pyrotechnic charge and said contactor device further comprises a piston structure near said pyrotechnic charge, wherein said piston structure is near said shaft structure and activation of said pyrotechnic charge causes said piston structure to push said shaft structure substantially into said separate internal compartment, and wherein said shaft structure comprises winged portions and said housing comprises a hard stop structure configured to abut against said winged portions to prevent overtravel of said shaft structure into said separate internal compartment.

18. The contactor device of claim 17, wherein said hard stop structure is configured to shear off when said pyrotechnic features activate to allow said shaft structure to travel further into said separate internal compartment.

19. A contactor device, comprising:

a housing;

internal components, said internal components comprising:

fixed contacts electrically isolated from one another, said fixed contacts at least partially surrounded by said housing;

one or more moveable contacts, said one or more moveable contacts allowing current flow between said fixed contacts when said one or more moveable contacts are contacting said fixed contacts;

a shaft structure having a first end and opposite second end, said shaft structure connected at said first end to said one or more moveable contacts;

a plunger structure connected to said shaft structure;

contact structures electrically connected to said internal components for connection to external circuitry; and a solenoid configured to control movement of said plunger structure; and pyrotechnic features closer to said first end than said second end and configured such that when a threshold current level passes through said internal components, said pyrotechnic features activate and interact with said shaft structure, such that said shaft structure changes configuration, such that said moveable contacts separate from said fixed contacts.

20. The contactor device of claim 19, further comprising arc blowout magnets.

21. The contactor device of claim 19, wherein said contactor device further comprises pyrotechnic pins in communication with said pyrotechnic features and said pyrotechnic features are configured to activate in response to an electrical activation signal received by said pins.

22. The contactor device of claim 19, wherein said pyrotechnic features comprise a single pyrotechnic charge.

23. The contactor device of claim 19, wherein said pyrotechnic features comprise a double charge structure comprising a first initiator charge and a secondary gas generator charge.

24. The contactor device of claim 23, wherein said initiator charge comprises a fast-burning material and said gas generator charge comprises a slow burning material.

25. The contactor device of claim 24, wherein said initiator charge comprises zirconium potassium perchlorate and said gas generator charge comprises boron potassium nitrate.

* * * * *